US006027418A

United States Patent [19]

van Nimwegen et al.

[11] Patent Number: 6,027,418

[45] Date of Patent: *Feb. 22, 2000

[54] PORTABLE FOLDING BASKETBALL GOAL SYSTEM

[75] Inventors: Edward G. van Nimwegen, North Ogden; Brent R. Allen, Ogden; Richard C. Nordgran, Roy, all of Utah

[73] Assignee: Lifetime Products, Inc., Clearfield, Utah

[ * ] Notice: This patent is subject to a terminal disclaimer.

[21] Appl. No.: 09/161,330

[22] Filed: Sep. 25, 1998

Related U.S. Application Data

[63] Continuation of application No. 09/114,025, Jul. 10, 1998, and a continuation of application No. 08/799,426, Feb. 12, 1997, Pat. No. 5,836,838.

[51] Int. Cl.[7] ..... A63B 63/08

[52] U.S. Cl. ..... 473/481

[58] Field of Search ..... 473/479, 481, 473/483, 485; 248/161, 157, 407

[56] References Cited

U.S. PATENT DOCUMENTS

| | | | |
|---|---|---|---|
| 1,924,811 | 8/1933 | Schulz . | |
| 3,017,183 | 1/1962 | Chalcroft . | |
| 3,025,058 | 3/1962 | Brumfield . | |
| 3,427,025 | 2/1969 | Procter . | |
| 3,716,234 | 2/1973 | Lancellotti . | |
| 3,788,642 | 1/1974 | Matras et al. . | |
| 3,820,784 | 6/1974 | Boitano et al. . | |
| 3,841,631 | 10/1974 | Dolan . | |
| 3,900,194 | 8/1975 | Ward et al. . | |
| 4,145,044 | 3/1979 | Wilson et al. . | |
| 4,412,679 | 11/1983 | Mahoney et al. . | |
| 4,534,556 | 8/1985 | Estlund et al. . | |
| 4,869,501 | 9/1989 | Anastasakis . | |
| 5,098,092 | 3/1992 | Aakre et al. . | |
| 5,158,281 | 10/1992 | Williams . | |
| 5,207,407 | 5/1993 | Fitzsimmons et al. . | |
| 5,248,140 | 9/1993 | Matherne et al. . | |
| 5,259,612 | 11/1993 | Matherne et al. . | |
| 5,375,835 | 12/1994 | Van Nimwegen et al. . | |
| 5,377,976 | 1/1995 | Matherne et al. . | |
| 5,390,914 | 2/1995 | Schroeder . | |
| 5,415,393 | 5/1995 | Fitzsimmons et al. . | |
| 5,507,484 | 4/1996 | Van Nimwegen et al. . | |
| 5,556,088 | 9/1996 | Mower et al. | 473/479 |
| 5,573,237 | 11/1996 | Van Nimwegen et al. . | |
| 5,632,480 | 5/1997 | Davis et al. . | |
| 5,836,838 | 11/1998 | Van Nimwegen et al. | 473/481 |

*Primary Examiner*—Raleigh W. Chiu
*Attorney, Agent, or Firm*—Madson & Metcalf

[57] ABSTRACT

A portable, folding basketball system employing a unique design to allow manual manipulation of the system from an extended position suitable for game play and a retracted position for compacted storage of the system. The system comprises a plurality of pole sections which form a pole of variable height, a base pivotally connected to the pole and having a recess for receiving the pole, a support arm pivotally connected to the base, a collar pivotally connected to the support arm and slidably engaging the pole, a bracket assembly pivotally connected to the pole, a backboard connected to the bracket assembly, and a rim assembly pivotally connected to the backboard. In the extended position the pole is generally directed upward at a playable height, the rim is in the horizontal position, and the backboard is in a playable position. In the retracted position, the pole is reduced in height and is nested within the recess of the base, the rim is disposed generally parallel to the backboard, and the backboard and bracket assembly are pivoted so that the majority of the backboard is disposed below the upper pole end.

61 Claims, 11 Drawing Sheets

PORTABLE FOLDING BASKETBALL GOAL SYSTEM

RELATED APPLICATIONS

This application is a continuation of our applications Ser. No. 09/114,025, filed on Jul. 10, 1998, for PORTABLE FOLDING BASKETBALL GOAL SYSTEM and Ser. No. 08/799,426, filed on Feb. 12, 1997, for FOLDABLE PORTABLE BASKETBALL STANDARD now U.S. Pat. No. 5,836,838.

BACKGROUND OF THE INVENTION

1. The Field of the Invention

The present invention is related to a portable basketball goal assembly which may be compacted for storage. More particularly, the present invention is related to a portable basketball goal system employing a unique design to enhance the compacted storage of the basketball goal system.

2. Technical Background

As the game of basketball has increased in popularity a greater number of people have purchased basketball goals for use at their homes. Such goals are typically permanently mounted such that the driveway of the home serves as the basketball court, as few homes have sufficient land surrounding the home to dedicate space for exclusive use as a basketball court. In some instances, locating where to mount a basketball goal can pose some difficulties. For example, in some homes, permanently mounting a basketball goal next to the driveway could provide a risk to traffic in the driveway, resulting in danger or damage to both automobiles and the goal system.

In some cases, the only viable location for mounting a basketball goal is in a location where permanently mounting a goal cannot be easily accomplished. Such a location may be where there is concrete or asphalt on the ground; thus, to mount the goal would require breaking a hole in the concrete or asphalt and then repairing the hole after the pole has been affixed in the ground. Such a procedure could be expensive and would most likely leave the driveway appearing unsightly.

Permanently installed outdoor basketball goals suffer from other disadvantages as well. Because they are permanently mounted, they are generally exposed to the weather throughout the entire year. Constant exposure to the weather can cause the goal system to prematurely wear by promoting oxidation. Premature oxidation can be particularly troublesome in goals having moving parts, such as goals that employ adjustable height or breakaway goal mechanisms. Constant exposure to the weather can cause these mechanisms to prematurely fail.

Even permanently mounted basketball goals utilized in indoor environments suffer from some disadvantages. For example, a typical school has a gymnasium which must serve many purposes. Having several basketball goals permanently mounted for use in the gymnasium may preclude or at least interfere with certain other activities. On formal occasions, objection may be made to the appearance of permanently mounted basketball goals.

In response to these and other disadvantages inherent in permanently mounted basketball goals, some designs of portable basketball goals have been developed. In order for a portable goal to be effective, sufficient weight must be employed to maintain the goal in a generally rigid position for use in playing the game of basketball. Hence, some portable designs utilize a great deal of weight, making the goals particularly difficult to move and possibly requiring the assistance of several people to set up or remove the goal. Additionally, such designs can be prohibitively expensive for people desiring to purchase one for use at their home.

Some prior-art designs have utilized removable weights, such as sand bags or metal weights, for use on the support structure. A principal disadvantage to the use of these types of removable weights is that they can be extremely heavy. While the support and the goal systems employing such designs may be easier to move, the weights are not. Some such designs, in an attempt to minimize the amount of removable weights required, are extremely large and bulky because they employ long lever arms in order to increase the effective weight of the removable weights.

In an attempt to make a portable basketball goal system that would be ideal for use at home, some designs have employed a base with a hollow cavity for receiving a ballast material. The ballast material may be water, sand, or other suitable material. Such systems can be easily moved to a desired location where the base is then filled with the ballast material, thereby providing sufficient weight to maintain the goal in a generally rigid position for use in playing basketball. When it is desired to move the goal, the ballast material is emptied out and the goal moved. The principal advantage of such a goal is in the use of the ballast material. Water and sand are inexpensive and convenient to use. Such ballast filled goal designs do suffer from some disadvantages, however. Having to fill and empty the goal each time the goal is to be set up or moved requires time and is an inconvenience. This procedure is particularly difficult if the goal is being used indoors. Furthermore, if water or sand is used, a large quantity will be required to effectively support the goal in a generally rigid position. Thus, when emptying the ballast material out of the goal, precautions have to be taken to ensure that the material is properly directed so it does not cause damage to the home or other surroundings. Also, the utilization of a water-filled base presents the hazard that the base receptacle or container aspect could be broken if the water within the base freezes and expands.

An almost universal disadvantage to the use of any portable basketball goal system is that they are difficult to store. A standard height basketball goal is approximately 12 feet. Few people have garages or storage sheds that will accommodate a 12 foot apparatus. Thus, such portable goals are usually stored in a horizontal position. Of course, storing a basketball goal system in a horizontal position takes up substantial floor space. Some garages or storage sheds do not have sufficient floor space to store a goal, forcing the owner to store the goal outside, thereby eliminating some of the advantages of the portable goal system.

One method of reducing the height of the basketball goal system is to have a height adjustable pole as is disclosed in U.S. Pat. No. 5,375,835 issued to Van Nimwegen et al. However, the amount that the pole can be decreased in height is limited and the backboard still adds additional height to the system. Height may be further decreased by removing the backboard but this is inconvenient as backboards are typically securely attached to the pole by bolts or screws. Furthermore, it is advantageous to retain connection of all parts of the basketball goal system for convenience and to prevent loss.

Because the base of the basketball goal system must be large enough to provide sufficient support for the system, the base requires a substantial amount of floor space. A base can typically require between 6 and 10 square feet of floor space for storage. Thus, even if the basketball goal system vertically fits in the garage or shed it may not be stored there for lack of floor space.

Thus, it would be an advancement in the art to provide a portable support for a basketball goal system which can use a ballast material for weight but can also be easily stored by one person without having to remove the ballast material.

It would also be an advancement in the art to provide a portable basketball goal system which decreases the maximum vertical height of the basketball goal system by reducing the vertical extension of the backboard and the height of the pole, thereby facilitating storage of the system.

It would be a further advancement in the art to provide a portable basketball goal system which would allow manipulation of the base, pole, backboard, and rim to position such members in substantially the same plane thereby permitting the system to be stored in a generally vertical position and reducing the amount of floor storage space.

It would be yet another advancement in the art to permit manual manipulation of the basketball goal system for storage while maintaining the interconnection of the rim, backboard, pole, and base.

Such a device is disclosed and claimed herein.

BRIEF SUMMARY AND OBJECTS OF THE INVENTION

The present invention is directed toward a portable, folding basketball goal system employing a unique design for manual manipulation into an extended position for use in game play and into a retracted position for compacted storage. The basketball goal system is designed to be stored with a reduced height and in a vertical position with all members of the system generally along the same vertical plane. The unique storage design reduces the amount of vertical space and floor space required to store the basketball goal system.

In one presently preferred embodiment, the basketball goal system comprises a plurality of pole sections which assemble to form a pole with a base end and a backboard end. The pole sections are configured to allow height variance in the pole. The pole is pivotally attached at the base end to a base. The base is configured with a recess on its exterior surface which runs from the proximal end to the distal end of the base. The pole is pivotally connected in the recess of the base near the proximal end of the base. The pole pivots from an extended position where the pole is generally directed upward for use in game play to a retracted position where the recess of the base receives the pole for compacted storage. When the pole is extended upward for use in game play, the pole may be substantially vertical to the playing surface or angled slightly to extend the backboard above and away from the base.

In one presently preferred embodiment, the base is configured with a cavity for receiving a ballast weight such as sand or water. This is necessary so that the base can fully support the basketball goal system during rigorous game play. In such an embodiment, the base is configured with an opening near, but spaced from, the top portion of the base such that when the base is filled with water to the point that the water level in the base reaches the opening, a void remains within the top of the cavity which does not fill with water. This is to allow expansion of the water in the case of freezing. A cap is also provided for covering the opening thereby preventing displacement of the ballast material. Alternatively, the base may be made of sufficient weight to act as a ballast in order to ensure the stability of the basketball goal system. The base is designed such that the height of the base slightly increases towards the distal end of the base. The effect of this design is that there will be more ballast material, and hence more weight, further from the proximal end of the base and thereby provide greater stability to the basketball goal system.

The basketball goal system may be moved by pivoting the basketball goal system about the proximal end of the base. A set of wheels are provided at the proximal end of the base for contacting the ground upon pivoting the system about the proximal end. With the entire basketball goal system thus tilted, the system may be easily moved for short distances.

The basketball goal system further comprises at least one support arm which pivotally connects to the base and to a slidable contractible collar. The collar slidably engages the pole. Thus, the support arm provides connecting support between the pole and the base. The collar slides along the pole while the support arm pivots near the base. This allows the support arms to move in conjunction with the pole from the extended position and the retracted position. Preferably, a collar fastener is connected to the collar. As the collar fastener is tightened, the collar is constricted to secure the position of the collar on the pole and to prevent pivotal movement of the pole. Alternatively, the collar fastener may be loosened which expands the collar and allows movement of the collar and pivotal movement of the pole. Thus, by means of the collar and collar fastener, the pole may be secured in either the extended position or the retracted position.

In one presently preferred embodiment, the basketball goal system further comprises a bracket assembly which has two parallel members which are pivotally connected near the backboard end of the pole. The pivotal connection is achieved by a bracket pin which is disposed on the bracket assembly and runs through the pole. The members run generally parallel to the pole, on opposing sides of the pole, and form a channel. This channel receives the pole when the basketball goal system is in the retracted position as described below.

A backboard is connected to the bracket assembly. The backboard and bracket assembly pivotally move together over the backboard end of the pole from the extended position to the retracted position. In the extended position the majority of the backboard extends further distal from the base than the backboard end of the pole. This provides a maximum height for the system. In the retracted position the majority of the backboard extends further proximal to the base than the backboard end of the pole which reduces the height of the system.

In one presently preferred embodiment, the invention further comprises a bracket lock pin which is disposed on the bracket assembly and is used to secure the backboard into the extended position. The bracket latch is received by a lock opening disposed on the pole. This secures the proper position of the backboard during rigorous game play. As stated previously, in one preferred embodiment, the pole is nested in the channel formed by the members of the bracket assembly in the retracted position.

A rim assembly, comprising a rim and a rim mount, is pivotally connected to is the backboard. The rim pivotally moves from the extended position where the rim is generally disposed perpendicular to the backboard for game play and the retracted position where the rim is generally disposed parallel to the backboard for compacted storage. In one presently preferred embodiment, pivotal connection of the rim is achieved by the use of a "U" bolt which is disposed through the backboard and through slots in the rim mount. The slots in the rim mount are sufficiently sized to allow pivotal movement of the rim mount about the "U" bolt. Biasing means are secured to the "U" bolt to ensure the position of the rim in either the extended position or the retracted position. The invention also comprises a rim latch which is disposed on the backboard. In the extended position, the rim latch is disposed through an opening in the rim mount thereby securing the position of the rim in a position generally perpendicular to the backboard. The rim latch ensures the stationary placement of the rim in the extended position during rigorous game play.

Thus, in the extended position, the basketball goal assembly has a base disposed horizontal to a play surface and a pole directed generally upward. The support arms extend from the base to the pole at angle and connect to the collar. The collar is tightened around the pole thereby securing the position of the pole in a generally upward direction. The backboard is secured near the backboard end of the pole such that the majority of the backboard extends further distal from the base than the backboard end of the pole. The backboard is disposed so that the top portion of the backboard is above the bottom portion of the backboard as is conventional for game play. The rim extends horizontally from the backboard for game play.

When storage is desired, the rim latches are unfastened and sufficient manual force is applied to the rim to overcome the biasing means and pivotally move the rim from a horizontal position to a vertical position where the rim is generally parallel to the backboard. The bracket lock pin is removed from the lock opening thereby allowing pivotal movement of the backboard. The backboard and bracket assembly pivotally move about the pole from the top portion being above the bottom portion with the majority of the backboard extending further distal to the base than the backboard end of the pole to the retracted position where the bottom portion is above the top portion with the majority of the backboard extending further proximal to the base than the backboard end of the pole. Next, the pole sections are adjusted to reduce the height of the pole. By pivoting the backboard and reducing the pole height, the total height of the basketball goal assembly can be reduced from 12 feet to approximately 8 feet which is a more feasible storage height.

The collar fastener is loosened thereby expanding the collar and permitting the collar to slide along the pole. The pole is tilted from its generally upward position until it lies generally within the recess of the base. The collar fastener may then be tightened to constrict the collar and secure the pole in the retracted position. The entire basketball goal system is pivoted about the proximal end of the base where the base wheels contact the ground surface. The basketball goal system is then positioned adjacent to a vertical surface, such as a wall, for vertical storage of the system. In this manner, compacted storage of the basketball goal system is achieved along a vertical plane thereby minimizing storage space.

Thus, it is an object of the present invention to provide a basketball goal system with a base having sufficient ballast to support the system while still being portable for storage without removing the ballast.

It is an additional object of the present invention to provide a basketball goal system which allows manipulation of the backboard and pole to decrease the maximum vertical height of the basketball goal system for storage purposes, thereby facilitating storage of the system in a garage or storage shed.

A further object of the present invention is to provide a basketball goal system which can be compacted for storage in which the compacted base, backboard, rim, and pole all lie substantially along the same vertical plane to reduce the amount of floor space for storage, thereby facilitating storage of the system in a garage or storage shed.

These and other objects and advantages of the present invention will become more fully apparent by examination of the following description of the preferred embodiments and the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DESCRIPTION OF THE PREFERRED EMBODIMENTS

Figure 1:
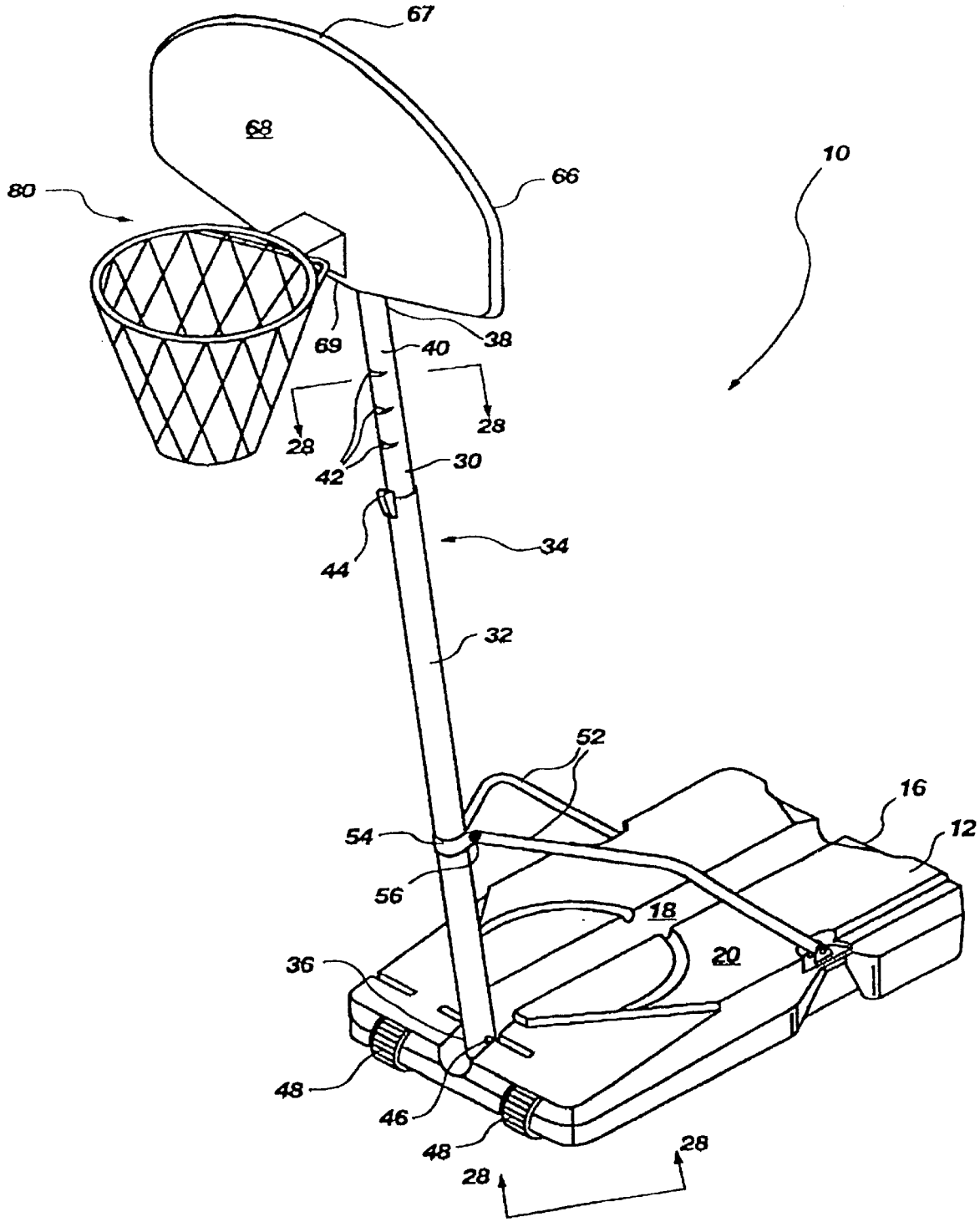
FIG. 1 is a perspective view of one embodiment of the present invention in its extended position.
Figure 2:
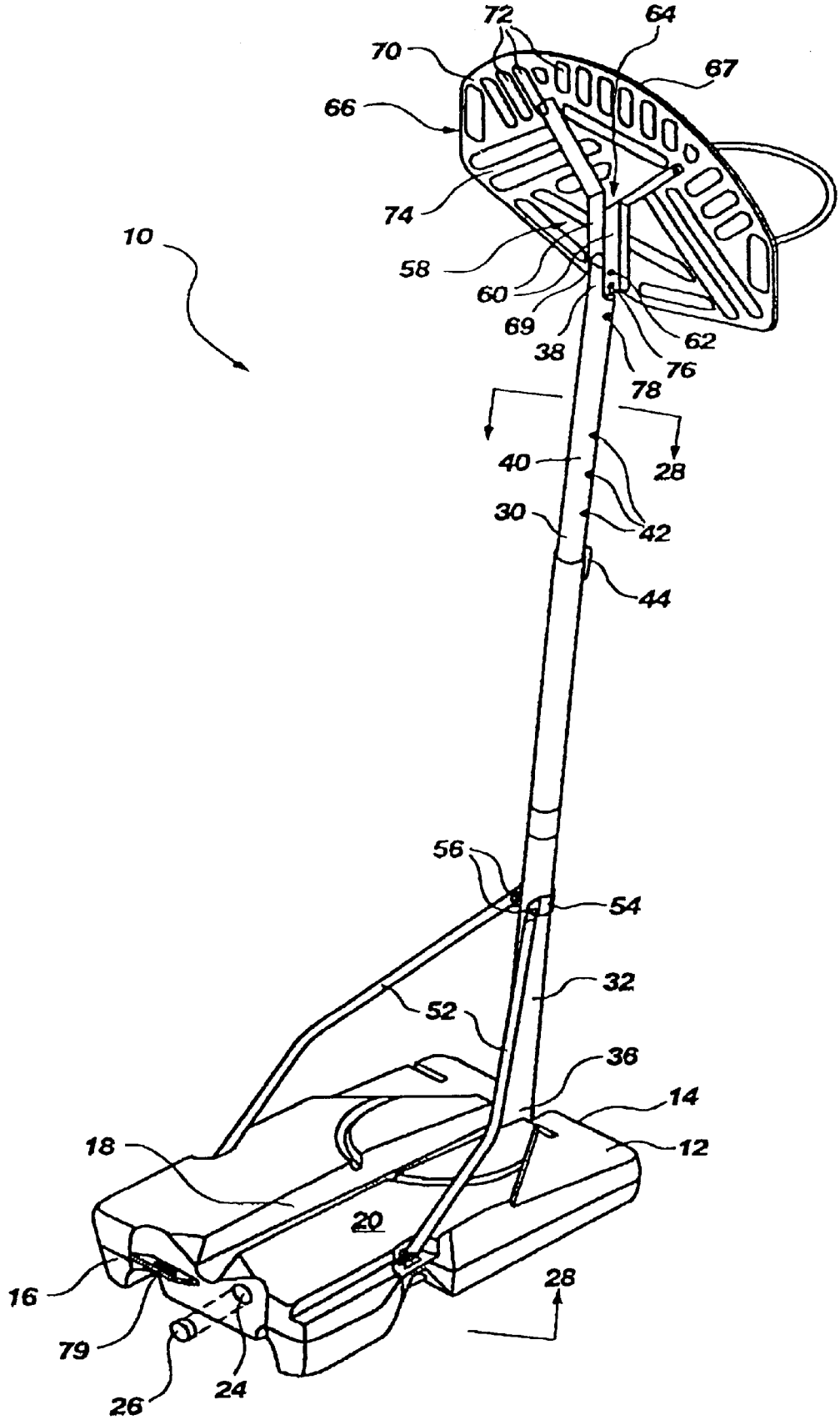
FIG. 2 is a perspective view of one embodiment of the present invention in its extended position.

Reference is now made to the figures wherein like parts are referred to by like numerals throughout. With particular reference to FIGS. 1 and 2, a portable, folding basketball goal system according to the present invention is generally designated 10. As shown in FIGS. 1 and 2, the basketball goal system is positioned in its extended position suitable for use in game play.

The basketball goal system includes a base 12. In one preferred embodiment the base is made of a low-density linear polyethylene, although one of skill will appreciate that a variety of materials may be employed. The base 12 has a proximal end 14 and a distal end 16. The base 12 is configured with a recess 18 on its upper exterior surface 20 which runs from the proximal end 14 to the distal end 16 of the base 12. In one presently preferred embodiment, the base 12 is designed to be filled with a ballast material to give the base 12 sufficient weight to support the basketball goal system and maintain the system in a relatively stationary disposition. The base 12 is further designed such that the height of the base 12 slightly increases towards the distal end 16 of the base 12. The effect of this design is that there will be more ballast material, and hence more weight, further from the proximal end 14 of the base 12 which provides greater stability to the basketball goal system.

With reference to FIG. 3, the base 12 is shown with a cavity 22 for receiving a ballast weight such as sand or water. This is necessary so that the base 12 can fully support the basketball goal system during rigorous game play. In such an embodiment, the base 12 is configured with an opening 24 near, but spaced from, the upper portion of the base 12 such that when the base 12 is filled with water to the point that the water level in the base 12 reaches the opening 24, a void remains within the top of the cavity 22 which does not fill with water. This is to allow expansion of the water in the case of freezing. A cap 26 is also provided for covering the opening 24 thereby preventing displacement of the ballast material. Alternatively, the base 12 may forgo the use of a cavity and comprise sufficient weight to act as a ballast in order to ensure the stability of the basketball goal system.

With reference again to FIGS. 1 and 2, the basketball goal system further comprises a plurality of pole sections 28, including at least an inner pole section 30 and an outer pole section 32 which mate in a telescoping manner to create a pole 34 having a base end 36 and a backboard end 38. Such a telescoping pole system is disclosed in U.S. Pat. No. 5,375,835 to Van Nimwegen et al. which is incorporated herein by reference. The pole 34 is adjustable in height by varying the position of the inner pole section 30 to the outer pole section 32. The inner pole section 30 has an exterior surface 40 containing a plurality of depressions 42. The depressions 42 are preferably formed by pressing rather than punching, so that no hole is formed in the exterior surface 40. Instead, a depressed portion of the exterior surface 40 is pressed inward.

A latch 44, pivotally mounted to the outer pole section 32, is configured to releasably engage the depressions 42. The depressions 42 are shaped so as to permit the inner pole section 30 to move upward without engaging the latch 44 and to engage the latch 44 if the inner pole section 30 moves downward far enough to bring a depression 42 adjacent the latch 44. Thus, the latch 44 is capable of movement between an engaging position for engaging a selected one of the depressions 42 and a releasing position in which the latch 44 is positioned free of the depressions 42. In this manner, the height of the pole 34 may be varied by the telescoping movement of the inner pole section 30 within the outer pole section 34 along a plurality of predetermined positions.

The base end 36 of the pole 34 extends into the recess 18 for attachment to the base 12. With reference again to FIG. 3, pivotal connection of the pole 34 to the base 12 is shown. The base 12 is connected to the pole 34 near the base end 36 of the pole 34 by a pin 46 which is disposed through the base 12 and through the pole 34. It is presently preferred that the pole 34 meet the base 12 approximately near the proximal end 14 of the base 12. The pole 34 pivots about pin 46 from the extended position where the pole 34 is generally directed upward for use in game play and the retracted position where the pole 34 is nested in the recess 18 of the base 12 for compacted storage. The recess 18 also serves to nest the pole 34 when the basketball goal system is packaged for sale.

In one presently preferred embodiment, wheels 48 are disposed on the proximal end 14 of the base 12 to assist in moving the basketball goal system. The wheels 48 are capable of serving as a rotating fulcrum upon which the effective weight of the basketball goal system may be supported. With the weight of the system on the wheels 48, the system may be maneuvered from place to place. The wheels 48 are configured to contact the ground surface as the basketball goal system is pivoted about the proximal end 14 of the base 12. Thus, the wheels 48 serve as a rotating fulcrum and support the effective weight of the basketball goal system when the base 12 is tilted from a stationary disposition as the system is pivoted about the proximal end 14 of the base 12.

Figure 3A:
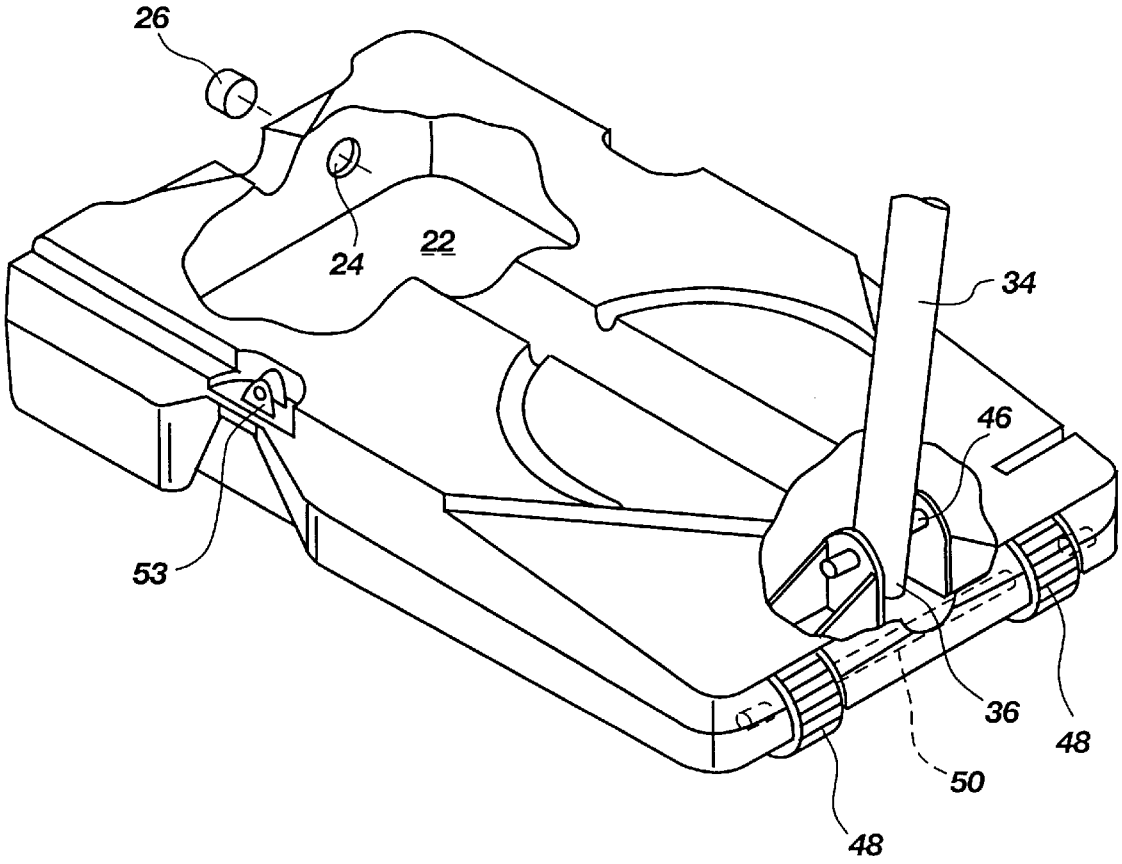
FIG. 3A is a perspective view of the base of present invention, with portions broken away to illustrate internal features of the base.
Figure 3B:
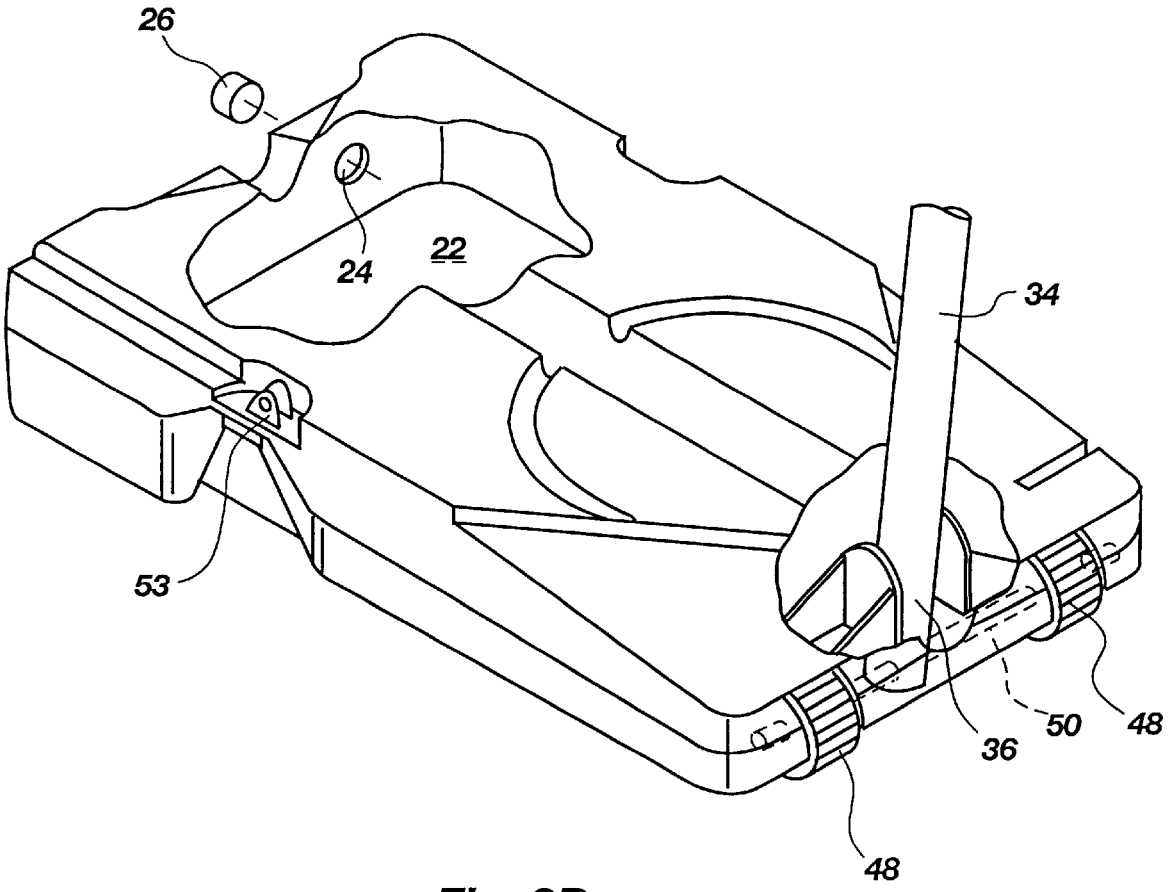
FIG. 3B is a perspective view of an alternative embodiment of the base of the present invention, with portions broken away to illustrate internal features of the base.

As shown in FIG. 3A, a rod 50 is disposed through the base 12 and through the wheels 48 to serve as an axle for the wheels 48. In an alternative embodiment, as shown in FIG. 3B the rod 50 may also pass through the pole 34 to provide pivotal connection of the pole 34 to the base 12. Such an embodiment eliminates the use of the pin 46.

With reference to FIGS. 1 and 2, the basketball goal system further comprises support arms 52 which pivotally connect to the base 12. The support arms 52 connect to the base 12 near the distal end 16 of the base 12 or approximately midway between the proximal and distal ends 14 and 16 to allow sufficient pivotal movement of the support arms 52. The support arms 52 pivotally connect to a contractible collar 54 which slidably engages the pole 34. The collar 54 slides along the pole 34 while the support arms 52 pivot at their respective connections with the collar 54 and with the base 12. This allows the support arms 52 to move in conjunction with pole 34 from the extended position and the retracted position. A collar fastener 56 is connected to the collar 54. As the collar fastener 56 is tightened, the collar 54 is constricted to secure the position of the collar 54 and prevent pivotal movement of the pole 34. Alternatively, the collar fastener 56 may be loosened which expands the collar 52 and allows movement of the collar 52 and pivotal movement of the pole 34. Thus, by means of the collar fastener 56, the pole 34 may be secured in either the extended position or the retracted position.

In the extended position, the support arms 52 are generally directed at an angle from their pivotal connection with the base 12 to their pivotal connection with the collar 54. In this position, the support arms 52 serve to support the pole 34 in a generally vertical position. In the retracted position, the pole 34 is nested in the recess 18 of the base 12 and the support arms 52 generally extend along the same plane as the pole 34 and the base 12. In the retracted position, the support arms 52 at least partially extend adjacent to the base 12. In one presently preferred embodiment, the exterior surface 20 of the base 12 is further configured with support arm recesses 57 for receiving at least a portion of the support arms 52 in the retracted position. Accordingly, nesting of the support arms 52 in the support arm recesses 57 increases the compacted storage of the system.

With reference to FIG. 2, the basketball goal system comprises a bracket assembly 58 which connects to the backboard end 38 of the pole 34. In one presently preferred embodiment, the bracket assembly 58 comprises two members 60 which are pivotally connected to the pole 34 near the backboard end 38. Pivotal connection is achieved by a bracket pin 62 which is disposed on the bracket assembly 58 and through the pole 34 near the backboard end 38. The members 60 run generally parallel to the pole 34, on opposing sides of the pole 34, and form a channel 64. The channel 64 receives the pole 34 when the basketball goal system is in the retracted position.

A backboard 66 is connected to the bracket assembly 58. The backboard 66 has a substantially flat faced front surface 68 and is configured to receive the impact of a basketball. The backboard 66 may be a conventional forty inch shatterproof plastic or fiberglass backboard. However, in one presently preferred embodiment, the backboard 66 is blow-molded from polyethylene and has a back surface 70 spaced apart from the front surface 68 and a plurality of offsets 72 positioned between the back surface 70 and front surface 68. The offsets 72 are defined by corresponding depressions in the back surface 70 such that each of the offsets 72 has a front end which is homogeneously secured to the front surface 68 and a back end which is homogeneously secured to the back surface 70. The front surface 68, back surface 70, and offsets 72 define an interior volume 74. The interior volume 74 is filled with a fill material principally formed of a significantly different material than the material of the front surface 68 and back surface 70. The fill material may be air, polyurethane foam, or another fill material. The backboard 66 of this embodiment is more fully detailed in U.S. Pat. No. 5,507,484 to van Nimwegen et al. and is incorporated herein by reference.

In order to better support the backboard 66 the members 60, after running parallel to one another, diverge from one another at approximately equal and opposite angles. The backboard 66 and bracket assembly 58 pivot together about the backboard end 38 of the pole 34. The backboard 66 has a top portion 67 and a bottom portion 69. In the extended position, the top portion 67 is above the bottom portion 69 as is suitable for game play. In the extended position, the majority of the backboard 66 and bracket assembly 58 extends further distal from the base 12 than the backboard end 38 of the pole 34. Accordingly, the majority of the backboard 66 and the bracket assembly 58 is above the backboard end 38 of the pole 34. Thus, in the extended position, the basketball goal system is at its maximum height.

A bracket lock pin 76 is disposed on the bracket assembly 58 below the bracket pin 62 such that the bracket lock pin 76 is further distal from the backboard end 38 of the pole 34. The bracket lock pin 76 passes through a lock opening 78. The lock opening 78 is disposed near the backboard end 38 of the pole 34 to receive the bracket lock pin 76 when the backboard 66 and bracket assembly 58 are in the extended position. The bracket lock pin 76 secures the position of the bracket assembly 58 and the backboard 66 in the extended position. In the extended position, the backboard 66 is locked in a stationary position to permit rigorous game play.

In a presently preferred embodiment the bracket lock pin 76 is a metal dowel having a head on one end and a spring loaded ball bearing on the opposing end. Force must be applied to the spring loaded ball bearing in order to insert or release the bracket lock pin 76 into or from the lock opening 78. In an alternative embodiment, the bracket lock pin 76 may be embodied as a threaded shaft with a head on one end and a threaded knob on the other for screwing onto the shaft.

When the backboard 66 and bracket assembly 58 are in the retracted position, they generally remain in position due to gravity. In the retracted position, the bracket lock pin 76 dangles from the bracket assembly 58 or pole 34 by means of a lanyard, rope, or other suitable attachment. Attaching the bracket lock pin 76 to the rest of the system is to prevent loss of the pin 76 when the bracket lock pin 76 is not engaged in the lock opening 78. In alternative embodiments, an additional lock opening 78 may be disposed on the pole 34 for receiving the bracket lock pin 76 when the backboard 66 and bracket assembly 58 are in the retracted position. In this embodiment, engaging the bracket lock pin 76 in the additional lock opening secures the backboard 66 and bracket assembly 58 in the retracted position.

Also shown in FIG. 2 is a distal base handle 79. The distal base handle 79 is used to secure the base 12 against a vertical surface in the retracted position as will be explained in greater detail below.

Figure 4A:
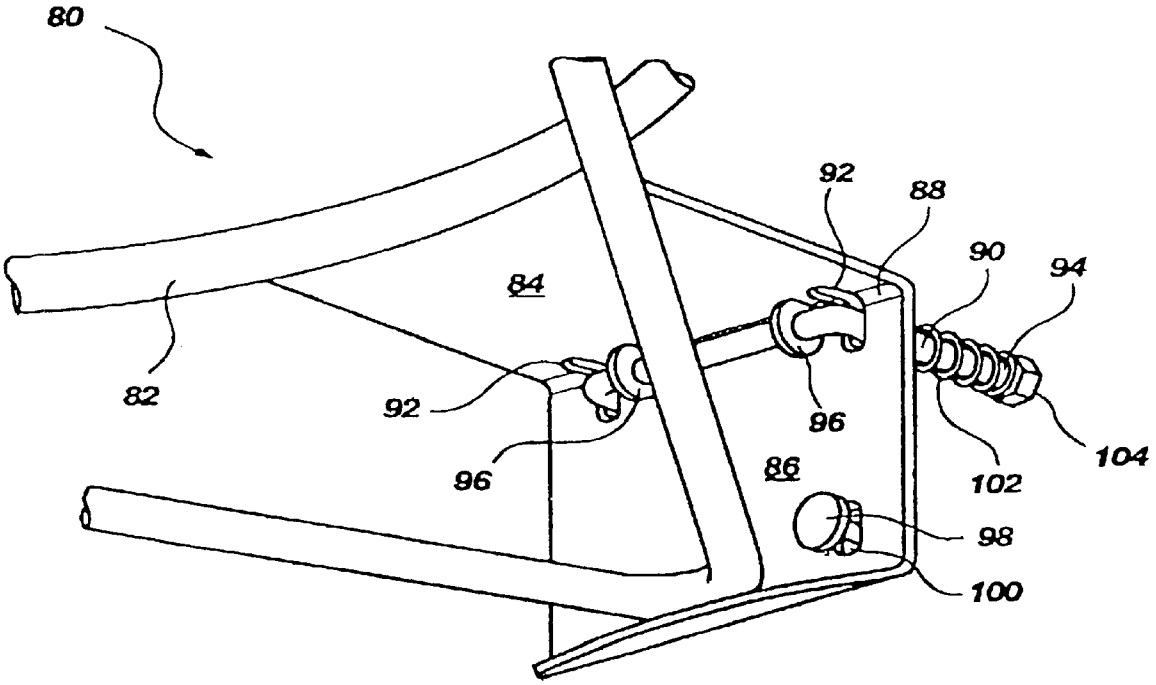
FIG. 4A is a perspective view of the rim assembly in the extended position.
Figure 4B:
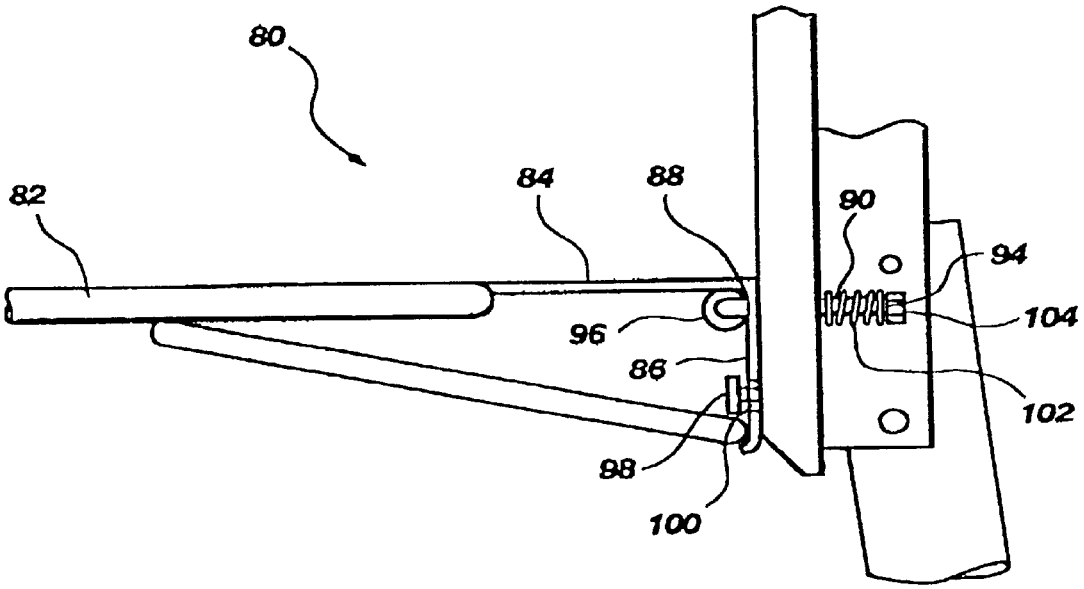
FIG. 4B is a side cross sectional view of the rim assembly in the extended position.

A rim assembly 80 is pivotally connected to the front surface 68 backboard 66. With reference to FIGS. 4A and 4B, one presently preferred embodiment of the rim assembly 80 is shown with the rim assembly 80 in the extended position. In the extended position, the rim 82 of the rim assembly 80 is generally perpendicular to the backboard 66 and horizontal to the ground surface. The rim assembly 80 further comprises a rim plate 84 which is connected to the rim 82. The rim plate 84 is connected to a rim mounting plate 86 at a generally perpendicular intersection 88. The rim mounting plate 86 is disposed parallel to the backboard 66 to support the rim assembly 80. The integrated connection of the rim plate 84 and the rim mounting plate 86 defines an "L" shaped member and are collectively referred to as the rim mount for the rim assembly 80. The perpendicular intersection 88 of the rim plate 84 and the rim mounting plate 86 allows mounting of the rim assembly 80 to the backboard 66 while supporting the rim 82 in the horizontal position.

The rim assembly 80 is pivotally connected to the backboard 66 by a rim pin 90 which is disposed through the rim assembly 80 approximately at the perpendicular intersection 88. A presently preferred embodiment for the rim pin 90 is a "U" bolt as shown best in FIG. 4A. The rim assembly 80 is configured with pivot slots 92 which allow the rim pin 86 access through the rim assembly 80. The pivot slots 92 are disposed at the perpendicular intersection 88 and extend partially into the rim plate 84 and rim mounting plate 86. The pivot slots 92 are configured with sufficient length to allow pivotal movement of the rim assembly 80 about the rim pin 86. The rim pin 90, as embodied as a "U" bolt, passes through the backboard 66 and each pivot slot 92 to provide the pivotal connection. The ends 94 of the rim pin 90 extend through the back surface 70 of the backboard 66.

The rim assembly 80 is also configured with pivot members 96 disposed adjacent to the perpendicular intersection 88 such that the pivot members 96 contact the rim plate 84 and the rim mounting plate 86. Preferably, at least two pivot members 96 are used to provide adequate pivotal support, but an alternative embodiment could have one pivot member 96. The pivot members 96 receive the rim pin 90 as the rim pin 90 extends through the pivot slots 92. In one presently preferred embodiment, shown in FIGS. 4A and 4B, the pivot members 96 are washers. The washers 96 are disposed on the rim pin 90 and rotatably engage the rim plate 84 and the rim mounting plate 86. Preferably, the rim plate 84 and the rim mounting plate 86 are configured with depressions to receive the washers 96 and maintain the position of the washers 96. The pivot members 96 provide pivotal interface between the movable rim assembly 80 and the generally stationary rim pin 90. As the rim assembly 80 pivots, the rim plate 84, rim mounting plate 86, and perpendicular intersection 88 rolls across the pivot members 96. The pivot members 96 rotate when the rim assembly 80 is pivoted to facilitate movement of the rim assembly 80. The pivot members 96 must be of sufficient size and strength to resist breaking as they are subject to considerable tension during pivotal movement.

In an alternative embodiment, the pivot members 96 are integrated with the rim plate 84, rim mounting plate 86, and perpendicular intersection 88 to form a unitary piece. In such an embodiment, the pivot members 96 move in conjunction with the rest of the rim assembly 80 instead of rotating separately.

One of skill in the art will appreciate that the rim pin 90 may have various embodiments. For example, the rim pin 90 may comprise two "L" shaped bolts. Each "L" bolt would protrude out the back surface 70 of the backboard and act to pivotally connect the rim mount 84 and backboard 66 in the same manner as the "U" bolt embodiment. Alternatively, two "U" bolts may be used to provide pivotal connection. In yet another embodiment, the rim pin may be configured as a "T" shaped bolt. In such an embodiment, a single pivot slot 92 would be required. Because the exact shape of the rim pin 90 is not critical to the teaching of the invention, other configurations for the rim pin 90 are possible and are included within the scope of the invention.

In one presently preferred embodiment rim latches 98 are disposed on the backboard 66 as shown in FIGS. 4A and 4B to secure the rim assembly 80 in the extended position. Preferably, at least two rim latches 98 are used in order to better secure the rim assembly 80. The rim mounting plate 86 is configured with latch openings 100 for receiving the rim latches 98 in releasable engagement. The engagement of the rim latches 98 to the rim mounting plate 86 secures the rim assembly 80 into the extended position. This is necessary in order to maintain the horizontal position of the rim 82 during rigorous game play.

In one presently preferred embodiment, shown in FIGS. 4A and 4B, the rim latch 98 consists of a threaded knob which is manually fastened onto a respective screw protruding from the backboard 66. Thus, after a screw is received through a latch opening 100, the knob is fastened onto the screw and tightened until the rim assembly 80 is secured to the backboard 66. In an alternative embodiment, the rim latch 98 is a hook with a biasing device for directing the hook towards the backboard 66. In this embodiment, the latch opening 100 would receive the hook and then the hook would be adjusted to engage the rim mounting plate 86. The biasing device, such as a spring, prevents the hook from releasing the rim mounting plate 86 during game play by forcing the rim mounting plate 86 towards the backboard 66.

The rim assembly 80 further comprises biasing means 102 which are disposed on the rim pin 90. In one presently preferred embodiment, shown in FIGS. 4A and 4B, the biasing means 102 comprises springs. The ends 94 of the rim pin 90 are threaded and are fitted with nuts 104 as the ends 94 protrude from the backboard 66. Alternatively, the rim pin 90 may be fitted with flanges on the ends 94. The springs 102 are disposed on the rim pin 90 between the nuts 104 and the back surface 70 of the backboard thereby maintaining tension in the springs 102.

The combination of the pivot members 96 and the springs 102 act as a detent to bias the rim assembly 80 in either the extended or retracted position. As the rim assembly 80 is pivoted about the perpendicular intersection 88, the pivot members 96 serve as a fulcrum and act to compress the springs 102. When the rim assembly 80 is in the extended or retracted position, the pivot members 96 do not compress the springs 102. Thus, to move the rim assembly 80 from either the extended or retracted position requires an initial force to overcome the bias of the springs 102 and compress the springs 102. The pivot members 96 and springs 102 provide a spring action which will prevent the rim assembly 80 from remaining in between the extended or retracted position and will force the rim assembly 80 into one or the other position. Furthermore, during game play, the springs 102 act to provide a degree of vertical flexibility in the rim assembly 80 to ease the tension in the rim 82 and reduce the likelihood of breakage such as during a slamdunk. This is desirable because the rim 82 is often subject to vertical forces during game play.

Figure 5:
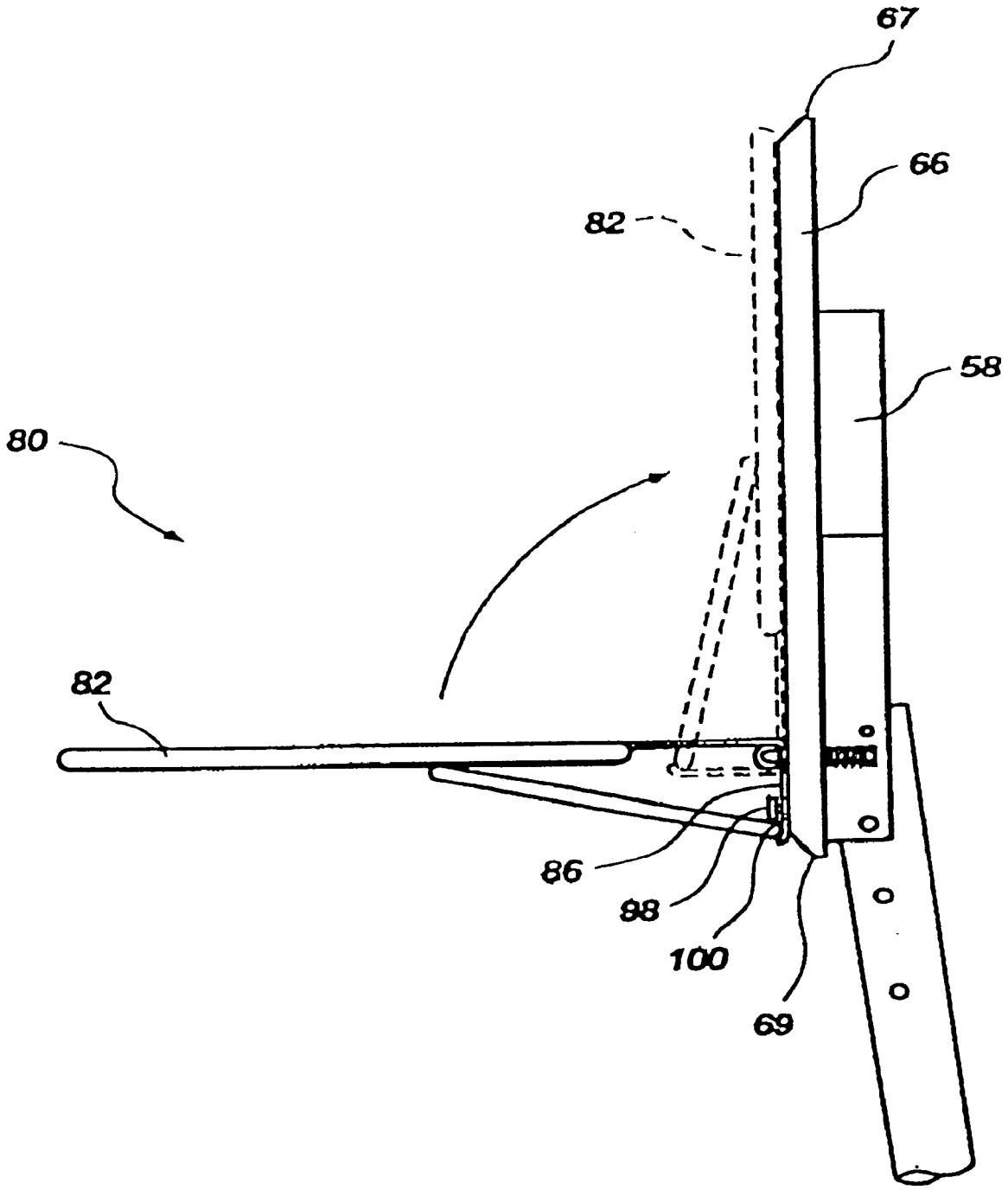
FIG. 5 is a side view of one embodiment of the present invention illustrating the pivotal rotation of the rim from its extended position to its retracted position (shown in phantom).

With reference to FIG. 5, a side view of the pivotal rotation of the rim assembly 80 from its extended position to its retracted position (shown in phantom) is shown. In the extended position for game play, the rim 82 extends generally perpendicular to the backboard 66 and horizontal to the ground surface. To pivot the rim assembly 80 to the retracted position, the rim latches 98 are disengaged from the latch openings 100 in the rim mounting plate 86. Next an upward force is applied to the rim assembly 80 to overcome the biasing means 102 and pivot the rim assembly 80 about the rim pin 90. At some point approximately midway between the extended position and the retracted position as the rim assembly 80 pivots towards the retracted position, the biasing means 102 acts to pull the rim assembly 80 into the retracted position. In the retracted position, the rim 82 is substantially parallel to the backboard 66 which reduces storage space for the basketball goal system. The rim assembly 80 may be pivoted back into the extended position by applying a downward force to overcome the biasing means 102. The rim assembly 80 is then made ready for game play by engaging the rim latches 98 through the latch openings 100 of the rim mounting plate 86.

Figure 6:
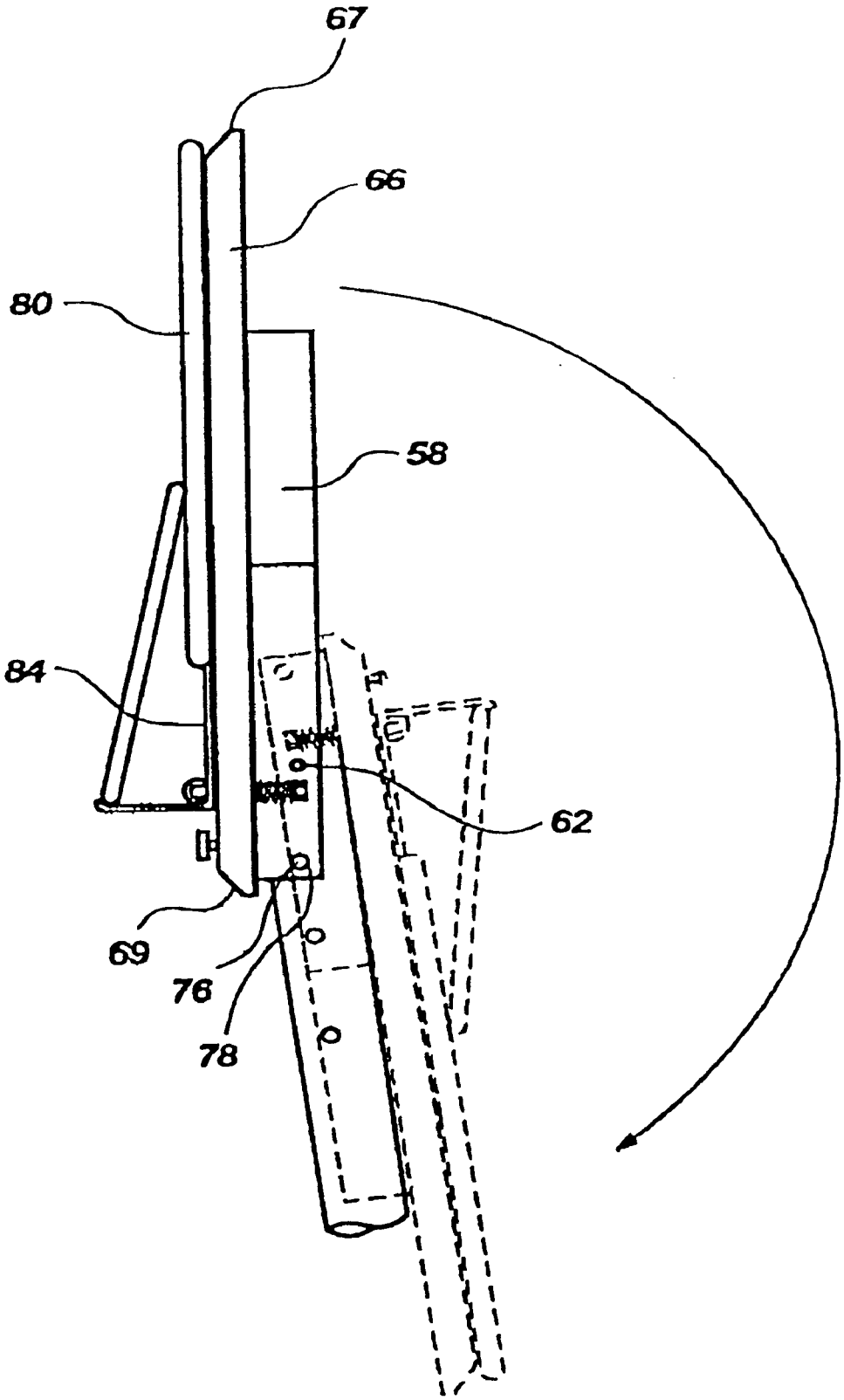
FIG. 6 is a side view of one embodiment of the present invention showing the pivotal rotation of the backboard from its extended position to its retracted position (shown in phantom).

With reference to FIG. 6, a side view of backboard 66 and the bracket assembly 58 from its extended position to its retracted position (shown in phantom) is shown. The backboard 66 and the bracket assembly 58 remain secured together throughout a pivotal rotation about the backboard end 38 of the pole 34. As shown, in the extended position the majority of the backboard 66 extends further distal from the base 12 than the backboard end 38 of the pole 34. Accordingly, the majority of the backboard 66 and the bracket assembly 58 extends above the backboard end 38 of the pole 34. Before rotating the backboard 66 and bracket assembly 58 to the retracted position, the locking bracket pin 76 is removed from the lock opening 78. At this point, the backboard 66 and bracket assembly 58 are free to pivot about the bracket pin 62.

The backboard 66 and bracket assembly 58 are pivoted to the retracted position so that the top portion 67 of the backboard 66 is located below the bottom portion 69 of the backboard 66. As shown in phantom, the retracted position results in the majority of the backboard 66 and bracket assembly 58 extending further proximal to the base 12 than the backboard end 38 of the pole 34. Accordingly, the majority of the backboard 66 and bracket assembly 58 are below the backboard end 38 of the pole 34, thereby reducing the height of the basketball goal system. In the retracted position, the pole 34 is nested within the channel 64 formed by the members 60 of the bracket assembly 58. The force of gravity generally retains the backboard 66 and bracket assembly 58 in the extended position. Alternatively, the backboard 66 and bracket assembly 58 are secured in the retracted position by inserting the locking bracket pin 76 in an additional lock opening 78 disposed in a location corresponding to the retracted position. A reversal of these steps takes the backboard 66 and bracket assembly 58 from the retracted position to the extended position.

Figure 7:
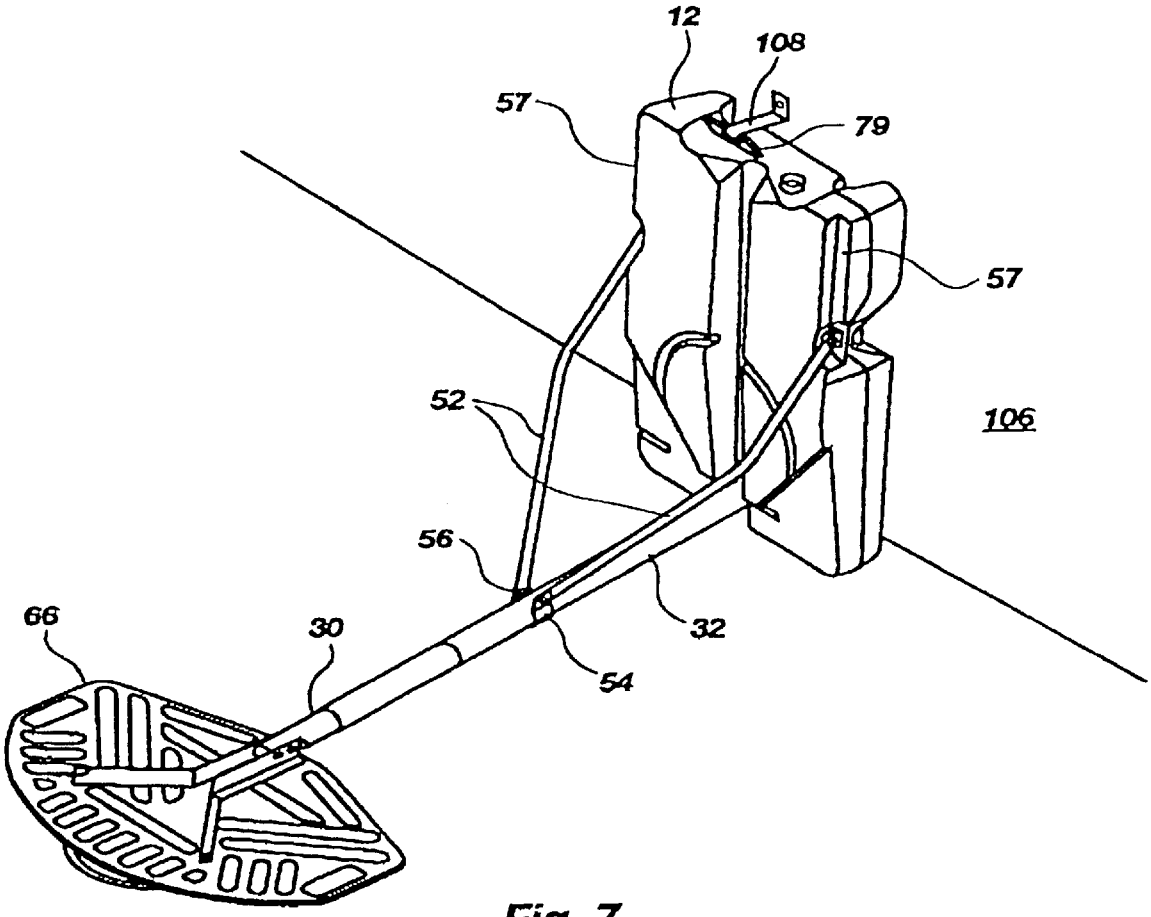
FIG. 7 is a perspective view of one embodiment of the present invention showing one step of taking the invention from the extended position to the retracted position.

With reference to FIG. 7, a diagram is shown illustrating manipulation of the basketball goal system from the extended position to the retracted position. As shown, the rim assembly 80 is pivoted into the retracted position so that the rim 82 generally runs parallel to the backboard 66. The system is directed toward vertical storage along a vertical surface 106 such as a wall. Accordingly, in manipulating the basketball goal system into the retracted position, it is desirable to position the system along the vertical surface 106. As shown in FIG. 7 the system is pivoted about the proximal end 14 of the base 12 to place the entire weight of the system on the wheels 48. With the system in a tilted position the base 12 is in a generally vertical position. The system is then maneuvered so that the base 12 is placed generally parallel against the vertical surface 106.

FIG. 7 also shows a first retainer 108 which is utilized to ensure that the system remains in the vertical position against the vertical surface 106. The first retainer 108 is a strip of material which is preferably bendable such as metal, canvas, plastic or other suitable material. The first retainer 108 connects to the vertical surface 106 at one end, curves about the distal base handle 79, and connects to the vertical surface 106 at the other end. Connection of the first retainer 108 to the vertical surface 106 may be done by fasteners such as bolts, screws, or adhesives. The retainer 108 prevents movement of the system from the vertical surface 106 and prevents damage to the system as well as possible injury. With the system secured in this manner, further manipulation of the system is possible without risk of damage or injury.

Figure 8:
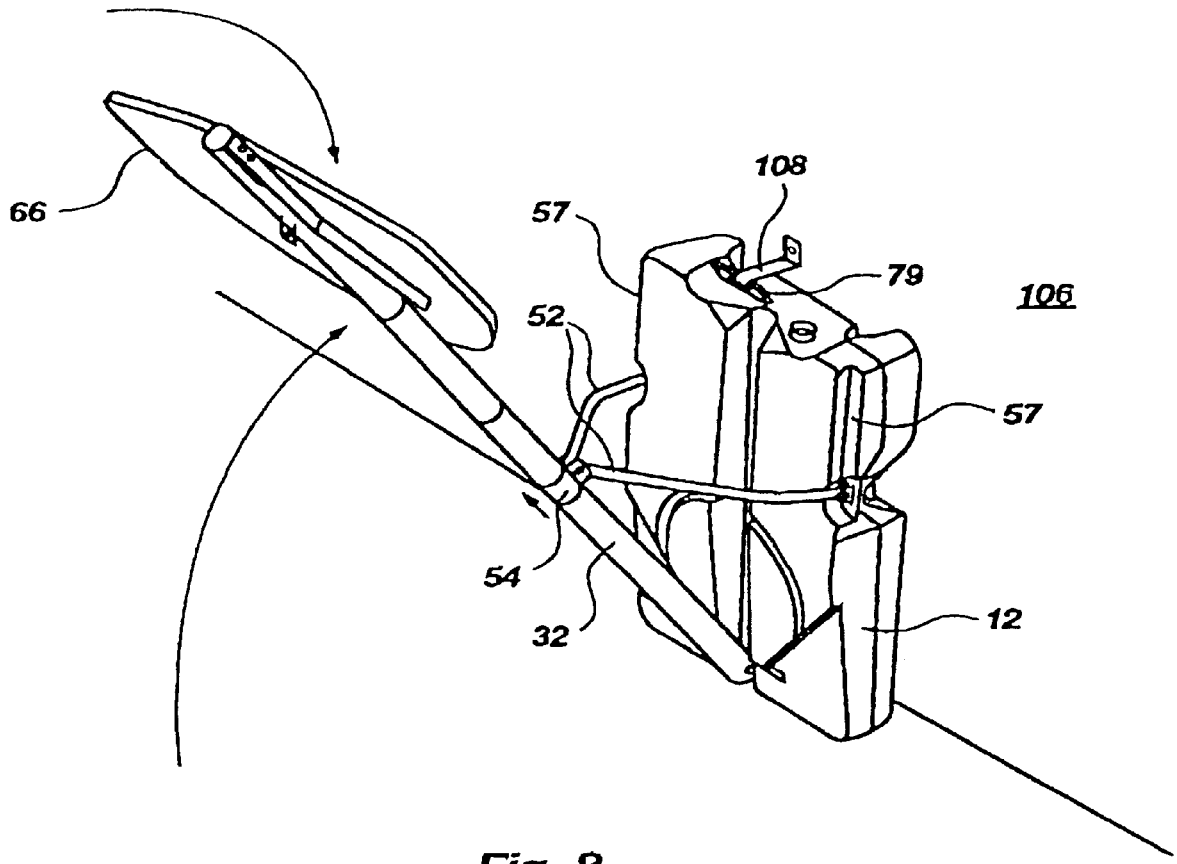
FIG. 8 is a perspective view of one embodiment of the present invention showing a subsequent step to that of FIG. 7 in taking the invention from the extended position to the retracted position.

With reference to FIG. 8, further manipulation of the basketball goal system from the extended position to the retracted position is shown. The backboard 66 and bracket assembly 58 are pivoted from the extended position to the retracted position as explained previously above. The height of the pole 34 is reduced by disengaging the latch 44 from a corresponding depression 42 in the inner pole section 30 and telescoping the inner pole section 30 into the outer pole section 32. The height of the pole 34 is then secured by engaging the latch 44 with a depression 42 corresponding to the lesser height. The collar fastener 56 is loosened thereby expanding the collar 54 and allowing pivotal movement of the pole 34. The base 12 is vertically disposed against the vertical surface 106 and the pole 34 is directed upward into the recess 18 of the base 12. As the pole 34 pivots upward, the collar 54 slides upward along the length of the pole 34. The support arms 52 follow the collar 54 upward until they extend in a vertical direction and partially nest in corresponding support arm recesses 57 in the base 12. Once the pole 34 is within the recess 18, the collar fastener 56 is tightened and the collar 54 constricted which secures the pole 34 in the retracted position. In this manner, the base 12, pole 34, support arms 52, backboard 66, and rim 82 are all directed into a substantially vertical plane adjacent the vertical surface 106.

Figure 9:
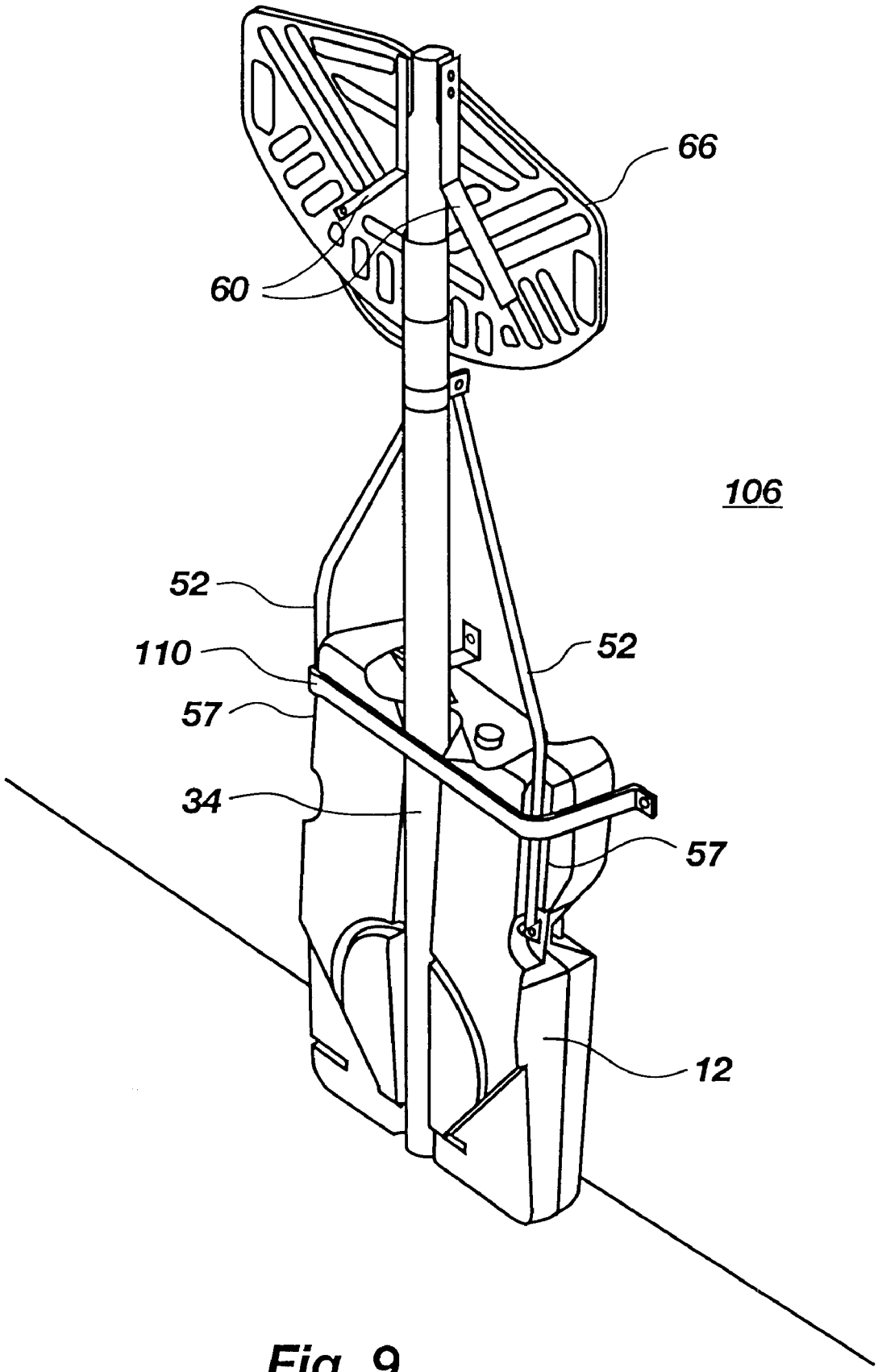
FIG. 9 is a perspective view of one embodiment of the present invention in its retracted position for compacted storage.

With reference to FIG. 9, the basketball goal system is shown in the retracted position for compacted storage. The system rests on the proximal end 14 of the base 12 thereby reducing the amount of floor space for storage. The system stands approximately 8 feet in height allowing convenient storage in a garage or shed. The system is supported by the vertical surface 106 and the first retainer 108 to prevent tipping of the system. As shown in FIG. 9, a second retainer 110 is also utilized to further ensure that the system remains in the vertical position against the vertical surface 106. Like the first retainer 108, the second retainer 110 is made of a material such as metal, canvas, plastic or other suitable material and is bendable. The second retainer 110 connects to the vertical surface 106 at one end, curves about the base 12 and pole 34, and connects to the vertical surface 106 at the other end. Preferably, the second retainer 110 curves about the base 12 close to the distal end 16 of the base 12. The second retainer 108 provides additional support to prevent movement of the system from the vertical surface 106.

Figure 10:
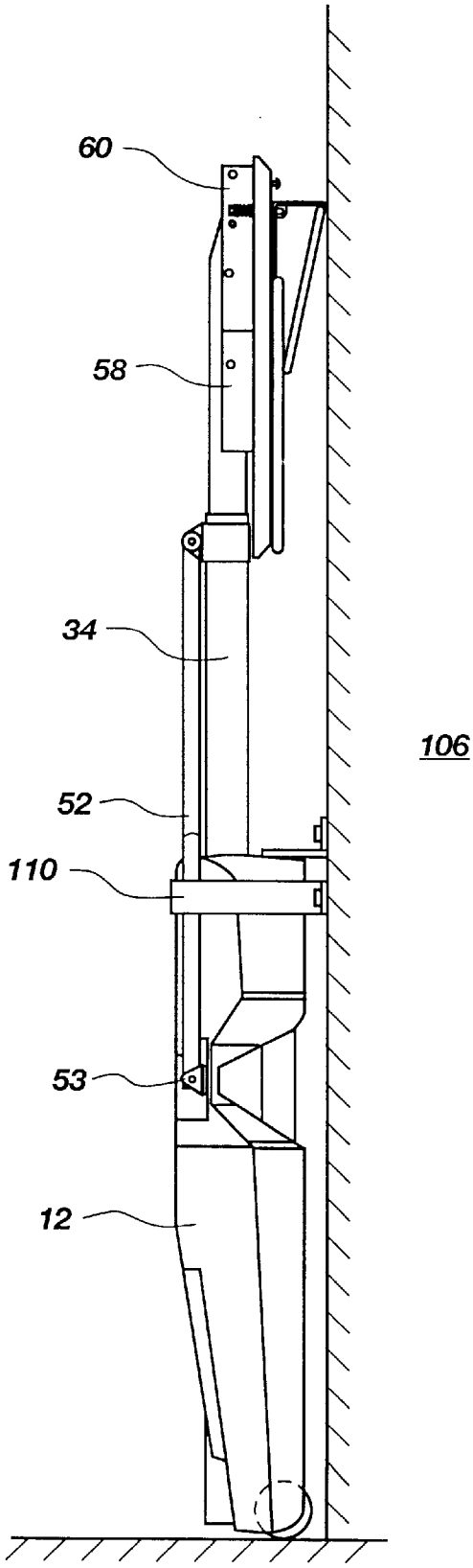
FIG. 10 is a side view of one embodiment of the present invention in its retracted position for compacted.

With reference to FIG. 10, a side view of the basketball goal system is shown in compacted storage against a vertical surface 106. As shown, the amount of floor space used by the system in a vertical disposition of the base is substantially reduced from a horizontal disposition of the base 12.

A reversal of the procedure outlined above takes the system from the retracted position to the extended position.

The invention provides a ballast supported basketball goal system which is portable for storage without removing the ballast. The invention allows manipulation of the system to decrease the vertical height of the system and place the base 12, pole 34, support arms 52, backboard 66, and rim 82 in a vertical plane thereby facilitating storage of the system in a garage or storage shed. The manipulation of the system from the extended position to the retracted position and visa versa is convenient and safe. Furthermore, because the components of the system remain largely connected to one another throughout the manipulation process, the opportunity for lost components is reduced.

It will be appreciated that aspects of the present invention may be embodied in either portable or permanently installed basketball goal systems. For instance, the bracket assembly 58, backboard 66, and rim assembly 80 may be employed in either case. Furthermore, the base 12 may be permanently mounted on a track on a vertical support for upright storage. These aspects may be employed alone or in various combinations with one another.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated in the appended claims rather than by the foregoing description. All changes within the meaning and range of the claims are to be embraced within their scope.

What is claimed is:

1. A basketball goal system capable of being manually manipulated into an extended position for use in game play and into a retracted position for compacted storage, comprising:

a pole having a base end and a backboard end, said pole being adjustable at variable heights;

a base having an exterior contour forming a recess for receiving said pole, wherein said pole is pivotally connected to said base proximate the base end thereby allowing the movement of said pole between the extended position corresponding to said pole being disposed in a generally upward direction suitable for use in game play and the retracted position corresponding to said pole being disposed in said recess of the base for compacted storage; and a support arm pivotally connected to said base thereby allowing movement of said support arm between a first engaging position in relation to said pole and a second disengaging position for compacted storage.

2. The basketball goal system as defined in claim 1 further comprising a backboard connected near the backboard end of said pole, said backboard being selectively movable in relation to said pole.

3. The basketball goal system as defined in claim 2 wherein said backboard comprises a substantially flat faced front surface configured for receiving the impact of a basketball, a back surface spaced apart from said front surface, and a plurality of offsets defining corresponding depressions in the back surface such that each of said offsets has a front end which is homogeneously secured to said front surface and a back end which is homogeneously secured to said back surface.

4. The basketball goal system as defined in claim 3 wherein the front surface, back surface, and offsets substantially define an interior volume and further comprise a fill material substantially filling the interior volume, said fill material principally formed of a significantly different material than the material of the front surface and back surface.

5. The basketball goal system as defined in claim 2 wherein said backboard is pivotally mounted in relation to said pole.

6. The basketball goal system as defined in claim 1 further comprising a rim assembly connected to said backboard.

7. The basketball goal system as defined in claim 1 wherein said pole comprises a plurality of pole sections capable of assembly to form a telescoping pole of variable height.

8. The basketball goal system as defined in claim 7 wherein said pole sections include at least an inner pole section and an outer pole section.

9. The basketball goal system as defined in claim 8 further comprising a pole latch, wherein said inner pole section comprises an exterior surface containing a plurality of depressions, said pole latch secured to said outer pole section and configured to releaseably engage the depressions in the exterior surface of said inner pole section, thereby allowing movement of said pole among a plurality of predetermined positions by telescoping movement of said inner pole section within said outer pole section and said pole being fixable at a predetermined length by engagement of a selected one of said depressions by said pole latch.

10. The basketball goal system as defined in claim 1 wherein said base is capable of holding a ballast material.

11. The basketball goal system as defined in claim 10 wherein said base comprises an opening into a cavity within said base and a cap for covering said opening and enclosing said cavity such that said cavity is capable of receiving and retaining ballast material.

12. The basketball goal system as defined in claim 1 further comprising a pivotal engagement disposed in relation to said base and said pole proximate said base end to facilitate a pivotal connection between said pole and said base.

13. The basketball goal system as defined in claim 12 wherein said pivotal engagement comprises a pivot pin.

14. The basketball goal system as defined in claim 1 further comprising at least one wheel disposed in relation to said base, said wheel being capable of serving as a rotating fulcrum upon which the effective weight of the basketball goal system may be supported for maneuverable from place to place.

15. The basketball goal system as defined claim 14 wherein said wheel is disposed on said base such that said wheel serves as a rotating fulcrum supporting the effective weight of the basketball system only if said base is tilted from a stationary disposition.

16. The basketball goal system of claim 14 further comprising a rod for disposition through said base such that said rod functions as an axle for said wheel.

17. The basketball goal system of claim 16 wherein said rod is further disposed through said pole near the base end thereby achieving pivotal connection of said pole to said base.

18. The basketball goal system of claim 1 further comprising a slidable collar pivotally connected to said support arm and slidably engaging said pole.

19. The basketball goal system of claim 1 further comprising a bracket assembly connected proximate the backboard end of said pole, said bracket assembly capable of being locked in the extended position for game play.

20. A portable basketball goal system capable of being manually manipulated into an extended position for use in game play and into a retracted position for compacted storage, comprising:

a plurality of pole sections capable of assembly to form a telescoping pole of variable height, said pole having a base end and a backboard end;

a base having an exterior contour forming a recess for receiving said pole, wherein said pole is pivotally connected to said base proximate the base end thereby allowing the movement of said pole between the extended position corresponding to said pole being disposed in a generally upward direction suitable for use in game play and the retracted position corresponding to said pole being disposed in said recess of the base for compacted storage; and a support arm pivotally connected to said base thereby allowing movement of said support arm between a first engaging position in relation to said pole and a second disengaging position for compacted storage;

a backboard being selectively movable in relation to said pole between a first playable position and a second storage position; and a rim assembly connected to said backboard.

21. The basketball goal system as defined in claim 20 further comprising a pivotal engagement between said base and said pole.

22. The basketball goal system as defined in claim 21 wherein said pivotal engagement comprises a pivot pin.

23. The basketball goal system of claim 20 further comprising a slidable collar pivotally connected to said support arm and slidably engaging said pole.

24. The basketball goal system of claim 20 further comprising a bracket assembly connected proximate the backboard end of said pole, said bracket assembly capable of being locked in the extended position tor game play.

25. The basketball goal system as defined in claim 20 wherein said pole sections include at least an inner pole section and an outer pole section.

26. The basketball goal system as defined in claim 25 further comprising a pole latch, wherein said inner pole section comprises an exterior surface containing a plurality of depressions, said pole latch secured to said outer pole section and configured to releasably engage the depressions in the exterior surface of said inner pole section, thereby allowing movement of said pole among a plurality of predetermined positions by telescoping movement of said inner pole section within said outer pole section and said pole being fixable at a predetermined length by engagement of a selected one of said depressions by said pole latch.

27. The basketball goal system as defined in claim 20 wherein said base is capable of holding a ballast material.

28. The basketball goal system as defined in claim 20 wherein said base comprises an opening into a cavity within said base and a cap for covering said opening and enclosing said cavity such that said cavity is capable of receiving and retaining ballast material.

29. The basketball goal system as defined in claim 20 further comprising at least one wheel disposed in relation to said base, said wheel being capable of serving as a rotating fulcrum upon which the effective weight of the basketball goal system may be supported for maneuverable from place to place.

30. The basketball goal system as defined claim 28 wherein said wheel is disposed on said base such that said wheel serves as a rotating fulcrum supporting the effective weight of the basketball system only if said base is tilted from a stationary disposition.

31. The basketball goal system of claim 30 further comprising a rod for disposition through said base such that said rod functions as an axle for said wheel.

32. The basketball goal system of claim 31 wherein said rod is further disposed through said pole near the base end thereby achieving pivotal connection of said pole to said base.

33. The basketball goal system as defined in claim 20 wherein said backboard is pivotally mounted in relation to said pole.

34. The basketball goal system as defined in claim 20 wherein said backboard comprises a substantially flat faced front surface configured for receiving the impact of a basketball, a back surface spaced apart from said front surface, and a plurality of offsets defining corresponding depressions in the back surface such that each of said offsets has a front end which is homogeneously secured to said front surface and a back end which is homogeneously secured to said back surface.

35. The basketball goal system as defined in claim 34 wherein the front surface, back surface, and offsets substantially define an interior volume and further comprise a fill material substantially filling the interior volume, said fill material principally formed of a significantly different material than the material of the front surface and back surface.

36. The basketball goal system as defined in claim 20 wherein the rim assembly comprises a rim, said rim assembly being pivotally connected to said backboard such that movement of said rim assembly is regulated from the extended position corresponding to said rim disposed substantially perpendicular to said backboard for use in game play and a retracted position corresponding to said rim being disposed generally parallel to said backboard for compacted storage.

37. The basketball goal system as defined in claim 36 wherein said rim assembly comprises a rim mount connected to said rim, at least one pivot member disposed on said rim mount, and a rim pin disposed on said backboard and passing through said rim mount and said pivot member to facilitate a pivotal connection between said rim assembly and said backboard.

38. The basketball goal system as defined in claim 37 wherein said rim assembly further comprises biasing means disposed on said rim pin to bias said rim assembly into the extended and retracted positions.

39. The basketball goal system as defined in claim 37 further comprising a rim latch disposed in relation to said backboard, said rim mount configured with an opening, said rim latch configured to releaseably engage the opening thereby securing said rim into an extended position for use in game play.

40. A basketball goal system capable of being manually manipulated into an extended position for use in game play an into a retracted position for compacted storage, said basketball goal system comprising:

a pole having a base end and a backboard end;

a base adapted to pivotally engage said pole proximal said base end such that the pole is moveable between said extended position corresponding to the pole being disposed in a generally upward direction suitable for use in game play and said retracted position corresponding to the pole being disposed for compacted storage;

a support arm pivotally connected to said base thereby allowing movement of said support arm between a first engaging position in relation to the pole and a second disengaging position for compacted storage; and a retaining member adapted for retaining said pole in said retracted position.

41. The basketball goal system as defined in claim 40, further comprising a backboard connected to said backboard end of said pole, said backboard being pivotally mounted in relation to the pole.

42. The basketball goal system as defined in claim 40, further comprising a rim assembly connected to said backboard.

43. The basketball goal system as defined in claim 40, wherein said pole comprises a plurality of pole sections capable of assembly to form a telescoping pole of variable height.

44. The basketball goal system as defined in claim 43, wherein said pole sections include an inner pole section and an outer pole section, wherein said inner pole section comprises an exterior surface containing a plurality of depressions, a latch being secured to said outer pole section and configured to releaseably engage said depressions in said exterior surface of said inner pole section, thereby allowing movement of said pole among a plurality of predetermined positions by telescoping movement of the inner pole section within the outer pole section and the pole being fixable at a predetermined length by engagement of a selected one of the depressions by said latch.

45. The basketball goal system as defined in claim 40, wherein said base is capable of holding a ballast material.

46. The basketball goal system as defined in claim 40, further comprising at least one wheel disposed in relation to said base, said wheel being capable of serving as a rotating fulcrum upon which an effective weight of said basketball goal system may be supported for maneuvering from place to place.

47. The basketball goal system as defined in claim 46, wherein said wheel is disposed on said base such that said wheel serves as a rotating fulcrum supporting the effective weight of the basketball system only if said base is tilted from a stationary disposition.

48. The basketball goal system as defined in claim 46, further comprising a rod for disposition through said base such that said rod functions as an axle for said wheel and is further disposed through said pole near said base end thereby achieving a pivotal connection of the pole to said base.

49. The basketball goal system as defined in claim 40, wherein said retaining member comprises a slidable collar pivotally connected to said support arm and slidably engaging said pole.

50. A basketball goal system capable of being manually manipulated into an extended position for use in game play an into a retracted position for compacted storage, comprising:

a pole having a base end and a backboard end;

a base adapted to pivotally engage said pole proximal said base end such that the pole is moveable between said extended position corresponding to the pole being disposed in a generally upward direction suitable for use in game play and said retracted position corresponding to the pole being disposed for compacted storage; and a support arm pivotally connected to said base thereby allowing movement of said support arm between a first engaging position in relation to said pole and a second disengaging position for compacted storage.

51. The basketball goal system as defined in claim 50, further comprising a backboard connected to said backboard end of said pole, said backboard being pivotally mounted in relation to the pole.

52. The basketball goal system as defined in claim 50, further comprising a rim assembly connected to said backboard.

53. The basketball goal system as defined in claim 50, wherein said pole comprises a plurality of pole sections capable of assembly to form a telescoping pole of variable height.

54. The basketball goal system as defined in claim 53, wherein said pole sections include an inner pole section and an outer pole section.

55. The basketball goal system as defined in claim 50, wherein said base comprises an exterior contour forming a recess for receiving said pole.

56. The basketball goal system as defined in claim 50, wherein said base is capable of holding a ballast material.

57. The basketball goal system as defined in claim 50, further comprising at least one wheel disposed in relation to said base, said wheel being capable of serving as a rotating fulcrum upon which an effective weight of said basketball goal system may be supported for maneuvering from place to place.

58. The basketball goal system as defined claim 57 wherein said wheel is disposed on said base such that said wheel serves as a rotating fulcrum supporting the effective weight of the basketball system only if said base is tilted from a stationary disposition.

59. The basketball goal system of claim 58 further comprising a rod for disposition through said base such that said rod functions as an axle for said wheel and is further disposed through said pole near said base end thereby achieving a pivotal connection of the pole to said base.

60. The basketball goal system of claim 50, further comprising a retaining member for retaining said pole in said extended position.

61. The basketball goal system of claim 60, wherein said retaining member comprises a slidable collar pivotally connected to said support arm and slidably engaging said pole.

* * * * *

UNITED STATES PATENT AND TRADEMARK OFFICE

CERTIFICATE OF CORRECTION

PATENT NO. : 6,027,418
DATED : February 22, 2000
INVENTOR(S) : van Nimwegen et al.

It is certified that error appears in the above-identified patent and that said Letters Patent is hereby corrected as shown below:

Column 16, line 53, please delete "tor", and insert therefor --for--.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*